US006823982B2

(12) United States Patent
Salicini et al.

(10) Patent No.: US 6,823,982 B2
(45) Date of Patent: Nov. 30, 2004

(54) TRANSFER WHEEL FOR TRANSFERRING PRODUCTS ALONG A WRAPPING LINE

(75) Inventors: Sandro Salicini, Monterenzio (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/419,696

(22) Filed: Apr. 21, 2003

(65) Prior Publication Data

US 2003/0230049 A1 Dec. 18, 2003

(30) Foreign Application Priority Data

Apr. 23, 2002 (IT) ..... BO2002A00221

(51) Int. Cl.[7] ..... B65G 29/00

(52) U.S. Cl. ..... 198/476.1; 198/470.1; 198/478.1

(58) Field of Search ..... 198/470.1, 478.1, 198/482.1, 469.1, 474.1, 476.1, 483.1

(56) References Cited

U.S. PATENT DOCUMENTS 3,378,128 A * 4/1968 Stevenson, Jr. et al. . 198/470.1
3,659,694 A * 5/1972 Harris ..... 198/470.1
4,519,180 A * 5/1985 Maure ..... 198/483.1
4,823,536 A * 4/1989 Manservigi et al. ..... 198/476.1
4,936,440 A * 6/1990 Focke et al. ..... 198/470.1

FOREIGN PATENT DOCUMENTS

GB 638776 6/1950

* cited by examiner

*Primary Examiner*—James R. Bidwell
(74) *Attorney, Agent, or Firm*—Ladas & Parry

(57) ABSTRACT

On a wrapping machine, the products for wrapping are transferred along a portion of a wrapping line by a transfer wheel, which has a number of radially projecting gripper-type peripheral seats, and rotates in steps about an axis of rotation to feed the peripheral seats in a given direction through a loading station, where each peripheral seat receives a relative product by means of a first transfer assembly, and through an unloading station where each product is expelled from the relative peripheral seat and fed through a wrapping assembly by means of a second transfer assembly; each peripheral seat having a first and a second jaw, of which the second jaw, located behind the first, is movable between a closed position and an open position.

8 Claims, 2 Drawing Sheets

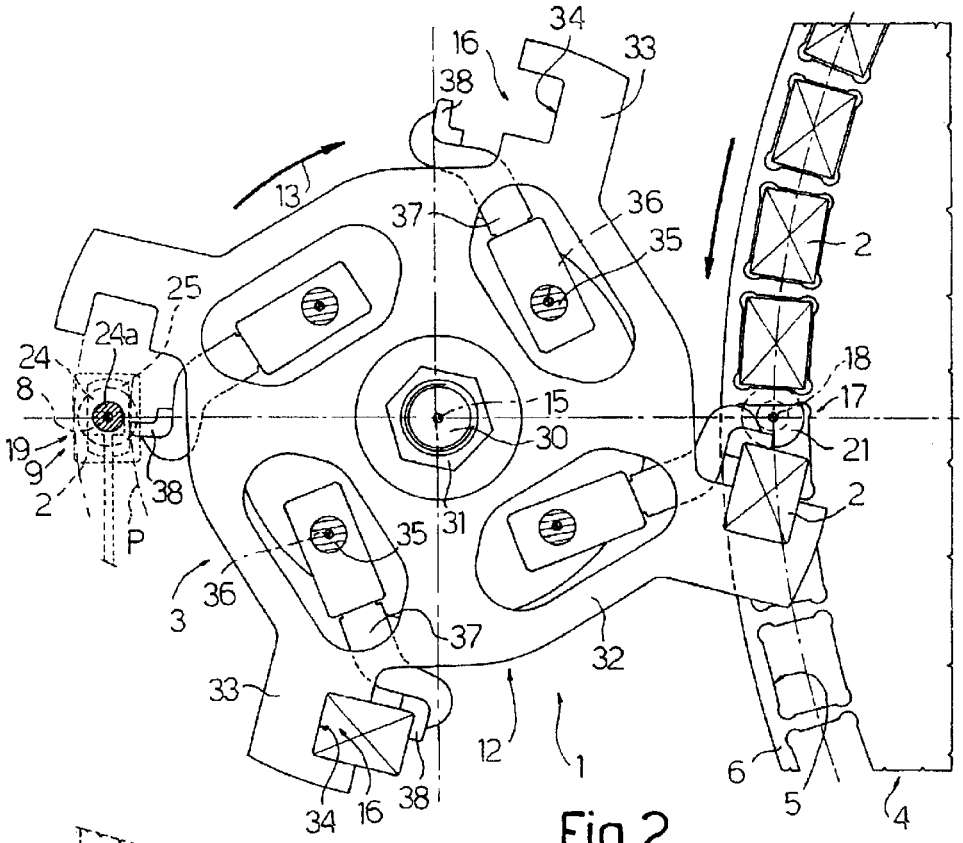
Fig.2
Fig.3
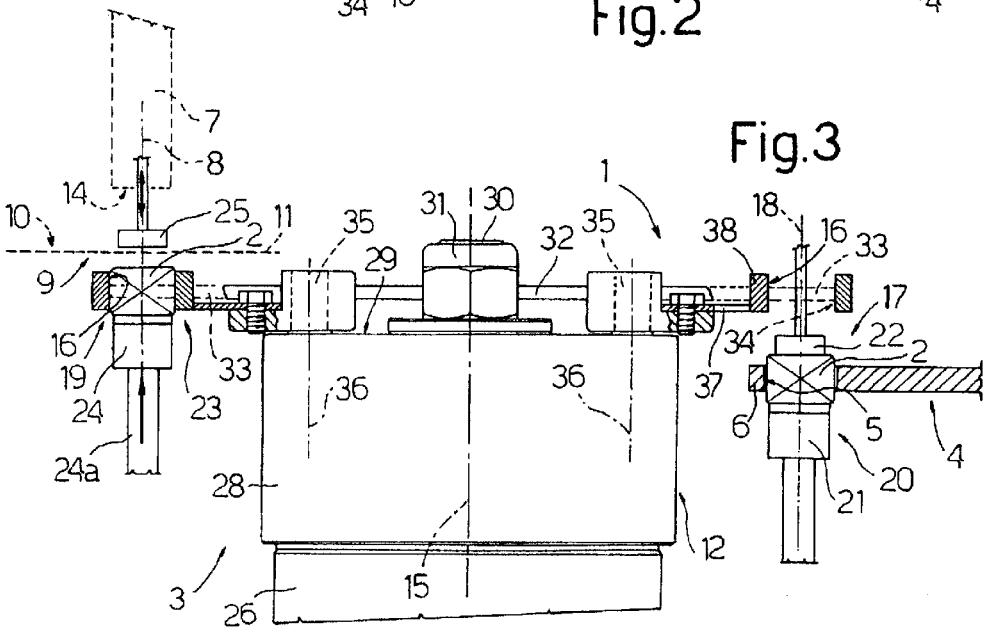

TRANSFER WHEEL FOR TRANSFERRING PRODUCTS ALONG A WRAPPING LINE

The present invention relates to a transfer wheel for transferring products along a wrapping line.

More specifically, the present invention relates to a transfer wheel for transferring products, of the type comprising a central body having a number of axially through, peripheral seats, and rotating in steps about an axis of rotation to feed the peripheral seats in a given direction and through a loading station and an unloading station; a first transfer assembly located at said loading station and for feeding said products to the relative peripheral seats; and a second transfer assembly located at the unloading station and for expelling said products axially from the relative peripheral seats, and feeding the products through a wrapping assembly.

The present invention is particularly advantageous for use on machines for wrapping sweets and similar, to which the following description refers purely by way of example.

BACKGROUND OF THE INVENTION

On machines for wrapping sweets and similar, a random stream of sweets is fed to a vertical-axis ordering plate, which has an outer ring with an orderly succession of through seats, each for receiving a respective sweet. Once arranged in orderly manner along the ring, the sweets are transferred to a single-sweet wrapping line by a vertical-axis transfer wheel having a number of peripheral through seats, which are fed successively to a first transfer station—in this case, a loading station—where each peripheral seat on the transfer wheel is positioned directly over a through seat on the ring to receive a sweet transferred to the transfer wheel by a bottom pusher moving vertically through the through seats on the ring, and a top counterpusher moving vertically through the peripheral seats on the transfer wheel. Two pushers of the type described above and located at a second transfer station—in this case, an unloading station—transfer the sweets from the transfer wheel to a further wrapped-sweet wheel via a sweet wrapping device.

On known transfer wheels of the type described above, the sweets are transferred during a stop of the transfer wheel, which cannot be started up again until the peripheral seats on the transfer wheel arrested at the transfer stations have been fully cleared by the pushers moving through them. This obviously results in considerable downtime, which, in the case considered, is further compounded, for example, by the pushers at the unloading station not only having to expel the sweets from the relative peripheral seats on the transfer wheel, but also having to feed the sweets through the wrapping assembly at travelling speeds which cannot exceed a given fairly low limit.

SUMMARY OF THE INVENTION

It is an object of the present invention to provide a transfer wheel designed to eliminate the aforementioned drawback.

More specifically, it is an object of the present invention to provide a transfer wheel designed to minimize loading and, above all, unloading downtime.

According to the present invention, there is provided a transfer wheel for transferring products along a wrapping line, the transfer wheel comprising a central body, which has a number of axially through, peripheral seats, and rotates in steps about an axis of rotation to feed said peripheral seats in a given direction and through a loading station and an unloading station; a first transfer assembly located at said loading station and for feeding said products to the relative said peripheral seats; and a second transfer assembly located at said unloading station and for expelling said products axially from the relative said peripheral seats, and feeding the products through a wrapping assembly; and being characterized in that each said peripheral seat is a gripper seat projecting radially outwards with respect to said central body, and comprising a first and a second jaw, of which the second jaw, located behind the first jaw in said direction, is a movable jaw movable between a closed position and an open position.

In a preferred embodiment of the transfer wheel according to the present invention, the second transfer assembly comprises a pusher having an actuating rod moving back and forth, parallel to said axis of rotation, through said unloading station and said wrapping assembly; said second jaw moving, in said open position, with said central body along a path of non-interference with said actuating rod.

BRIEF DESCRIPTION OF THE DRAWINGS

A non-limiting embodiment of the invention will be described by way of example with reference to the accompanying drawings, in which:

FIG. 2 is similar to FIG. 1, and shows the FIG. 1 transfer wheel in a different operating position;

FIG. 3 shows a section along line III—III in FIG. 1.

DETAILED DESCRIPTION OF THE INVENTION

Figure 1:
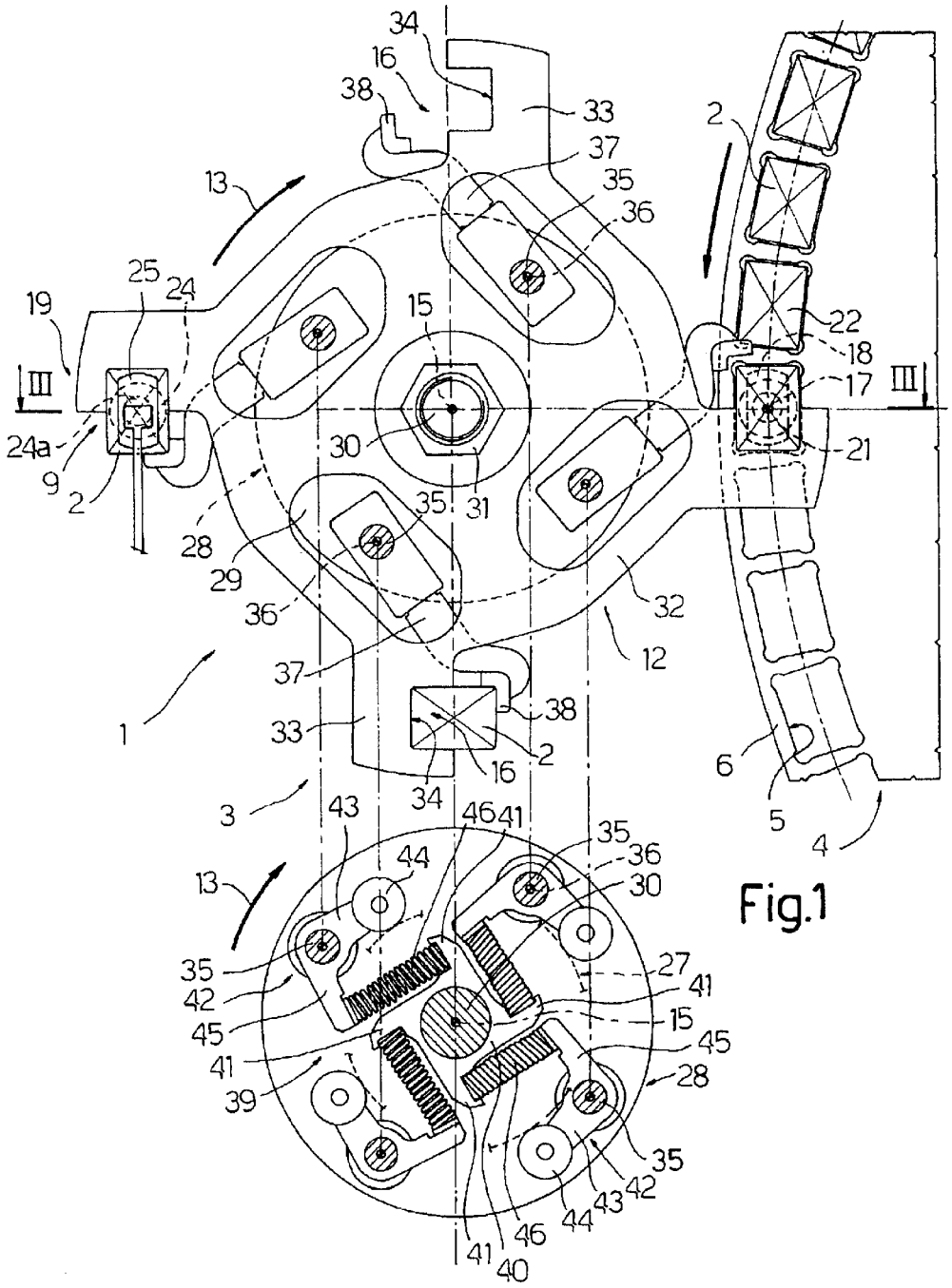
FIG. 1 shows a schematic plan view, with parts in section and parts removed for clarity, of a preferred embodiment of the transfer wheel according to the present invention.

Number 1 in FIG. 1 indicates as a whole a machine for wrapping sweets 2 along a wrapping line 3 comprising a known input ordering plate 4 for receiving a random stream of sweets 2, and for arranging sweets 2 in an orderly succession inside respective through seats 5 arranged in orderly manner along an outer ring 6 of ordering plate 4.

As shown in FIG. 3, wrapping line 3 also comprises a known wrapping assembly 7 extending along a substantially vertical axis 8, directly over an output station 9 of a known feed line 10 for supplying a succession of sheets 11 of wrapping material for individual sweets 2. Wrapping assembly 7 successively receives sweets 2, each associated with a relative sheet 11 of wrapping material; folds each sheet 11 of wrapping material in known manner about relative sweet 2; and feeds the wrapped sweets 2 successively to a further known gripper wheel (not shown) rotating about a horizontal axis and located over wrapping assembly 7.

As shown more clearly in FIG. 1, wrapping line 3 also comprises a transfer wheel 12 interposed between ring 6 of ordering plate 4 and an input of wrapping assembly 7 located directly over output station 9. Transfer wheel 12 is mounted to rotate in steps—in a clockwise direction 13 in FIG. 1—about an axis 15 parallel to axis 8 and to the axis (not shown) of ordering plate 4, and comprises a number of peripheral through seats 16 open radially outwards, and each of which stops at a transfer station 17—in the example shown, a loading station for transfer wheel 12—in a position directly over a seat 5 in ring 6 and aligned with seat 5 along a vertical axis 18 (FIG. 3), and then stops at a further transfer station 19—in the example shown, an unloading station for transfer wheel 12—in a position directly beneath output station 9 and aligned with axis 8. Obviously, peripheral seats 16 on transfer wheel 12 are arranged about axis 15 so that, when one peripheral seat 16 stops at transfer station 17, another peripheral seat 16 stops at transfer station 19.

With particular reference to FIG. 3, sweets 2 are transferred from ring 6 to transfer wheel 12 at transfer station 17 by means of a transfer assembly 20 comprising a bottom pusher 21 and a top counterpusher 22, both coaxial with and moving back and forth along axis 18. More specifically, pusher 21 moves, through a seat 5 aligned with axis 18, between a rest position beneath a sweet 2 inside seat 5, and a work position beneath the same sweet 2 fed into a peripheral seat 16 aligned with said seat 5 along axis 18; and counterpusher 22 moves, through a peripheral seat 16 aligned with axis 18, between a rest position over said peripheral seat 16, and a work position on top of a sweet 2 inside a seat 5 aligned with said peripheral seat 16 along axis 18.

Each sweet 2 is expelled from relative peripheral seat 16 at transfer station 19 by means of a transfer assembly 23 comprising a bottom pusher 24 with a push rod 24*a,* and a top counterpusher 25, both coaxial with and moving back and forth along axis 8. More specifically, pusher 24 moves—through a peripheral seat 16 aligned with axis 8, and through output station 9 and wrapping assembly 7—between a rest position beneath a sweet 2 inside peripheral seat 16, and a work position beneath the same sweet 2 fed into a radial gripper (not shown) forming part of said gripper wheel (not shown) and facing an output (not shown) of wrapping assembly 7; while counterpusher 25 forms part of said gripper wheel (not shown), and moves—through output station 9, wrapping assembly 7, and the inlet of a said radial gripper (not shown) aligned with axis 8—between a rest position over said peripheral seat 16, and a work position inside said radial gripper (not shown).

As shown in FIG. 3, transfer wheel 12 comprises a fixed bottom support 26 coaxial with axis 15 and supporting on top a fixed cylindrical cam 27 (FIG. 1) extending about axis 15 and housed inside a cylindrical bell 28, which is coaxial with axis 15, is positioned with its concavity facing downwards, and is bounded at the top by a wall 29 perpendicular to axis 15 and fitted through with a drive shaft 30, which extends, coaxially with axis 15, through support 26, cam 27, and wall 29, and is connected to wall 29 by a nut 31 to rotate bell 28 in steps about axis 15 in direction 13.

A plate 32 is located over wall 29, and defines, with support 26 and bell 28, a central body of transfer wheel 12. Plate 32 is substantially circular, is coaxial with axis 15, is integral with bell 28, and comprises a number of peripheral, substantially radial appendixes 33, each of which extends outwards of support 26, bell 28, and the outer periphery of plate 32, and has, along the rear side in direction 13, a cavity 34 for partly housing a sweet 2 and defining a fixed front portion of a respective peripheral seat 16.

At each appendix 33, an eccentric pin 35 is fitted through wall 29, rotates with respect to wall 29 about a respective axis 36 parallel to axis 15, and is fitted with a radial arm 37, an end portion of which projects outwards of the outer periphery of plate 32, and supports a jaw 38, which extends upwards from relative arm 37, outwards of plate 32 and upstream from relative appendix 33 in direction 13, is coplanar with relative appendix 33, and faces relative cavity 34 to define, with cavity 34, a relative peripheral seat 16. In other words, each peripheral seat 16 is a gripper seat, of which relative appendix 33 defines a fixed jaw, and jaw 38 is a movable jaw which oscillates about relative axis 36 between a closed position (peripheral seat 16 at the bottom in FIG. 2) retaining a sweet 2, and an open position (peripheral seat 16 on the left in FIG. 2), in which jaw 38 is rotated almost completely radially inwards with respect to relative cavity 34, into a position, as explained in detail later on, of non-interference with push rod 24*a*.

Oscillation of each jaw 38 about relative axis 36 is controlled by an actuating device 39 housed inside bell 28, including cam 27, and which, as shown in FIG. 1, comprises a star wheel 40 fitted to the drive shaft 30 and having a number of peripheral appendixes 41 equal in number to pins 35; and, for each pin 35, a rocker arm 42 fitted to relative pin 35 and comprising an arm 43 located in front of relative pin 35 in direction 13 and supporting a tappet roller 44 cooperating with cam 27. Each rocker arm 42 also comprises a further arm 45 located behind relative pin 35 in direction 13, and cooperating with a respective appendix 41 of wheel 40 via the interposition of a spring 46 compressed between relative arm 45 and relative appendix 41 to keep relative tappet roller 44 in contact at all times with the periphery of cam 27.

Operation of transfer wheel 12 is easily deducible from the foregoing description with no further explanation required.

It should be pointed out, however, that, when a peripheral seat 16 stops at transfer station 19, and relative jaw 38 rotates backwards in direction 13 to release relative sweet 2 (peripheral seat 16 on the left in FIG. 2), the open jaw 38 is located radially inwards of push rod 24*a* with respect to axis 15, and, still in the open position, moves with plate 32 along a path P of non-interference with push rod 24*a*.

As soon as sweet 2 is expelled from peripheral seat 16, transfer wheel 12 can be restarted, thus reducing unloading downtime to practically zero.

What is claimed is:

1. A transfer wheel (12) for transferring products (2) along a wrapping line (3), the transfer wheel (12) comprising a central body (26, 28, 32), which has a number of axially through, peripheral seats (16), and rotates in steps about an axis of rotation (15) to feed said peripheral seats (16) in a given direction (13) and through a loading station (17) and an unloading station (19); a first transfer assembly (20) located at said loading station (17) and for feeding said products (2) to the relative said peripheral seats (16); and a second transfer assembly (23) located at said unloading station (19) and for expelling said products (2) axially from the relative said peripheral seats (16), and feeding the products (2) through a wrapping assembly (7); and being characterized in that each said peripheral seat (16) is a gripper seat projecting radially outwards with respect to said central body (26, 28, 32), and comprising a first and a second jaw (33, 38), of which the second jaw (38), located behind the first jaw (33) in said direction (13), is a movable jaw movable between a closed position and an open position.

2. A transfer wheel (12) as claimed in claim 1, wherein the second transfer assembly (23) comprises a pusher (24) having an actuating rod (24*a*) moving back and forth, parallel to said axis (15) of rotation, through said unloading station (19) and said wrapping assembly (7); said second jaw (38) moving, in said open position, with said central body (26, 28, 32) along a path (P) of non-interference with said actuating rod (24*a*).

3. A transfer wheel (12) as claimed in claim 1, wherein said first jaw (33) is a fixed jaw.

4. A transfer wheel (12) as claimed in claim 1, wherein said central body (26, 28, 32) comprises a plate (32) having a number of substantially radial appendixes (33) projecting outwards from an outer periphery of the plate (32); each said appendix (33) having, at the rear, a lateral cavity (34)

defining part of a respective said peripheral seat (16), and constituting said first jaw (33) of the peripheral seat (16).

5. A transfer wheel (12) as claimed in claim 4, wherein each said second jaw (38) is supported, outwards of the outer periphery of said plate (32), by an arm (37) mounted to oscillate, with respect to said plate (32) and under the control of actuating means (39), about a respective axis (36) of oscillation parallel to said axis (15) of rotation and fixed with respect to the plate (32).

6. A transfer wheel (12) as claimed in claim 5, wherein said actuating means (39) comprise a cylindrical cam (27) surrounding said axis (15) of rotation; and, for each said arm (37), a rocker arm (42) pivoting about said axis (36) of oscillation and integral with the arm (37); said rocker arm (42) comprising an arm (43) fitted with a tappet (44) cooperating with said cam (27).

7. A transfer wheel (12) as claimed in claim 6, wherein each said rocker arm (42) comprises a further arm (45); elastic means (46) acting on said further arm (45) to push said tappet (44) against said cam (27).

8. A machine (1) for wrapping products (2), the machine (1) comprising a wrapping line (3), and a transfer wheel (12) for feeding said products (2) successively to said wrapping line (3); and said transfer wheel (12) being a wheel as claimed in claim 1.

* * * * *